US009068710B2

(12) United States Patent
Lai

(10) Patent No.: US 9,068,710 B2
(45) Date of Patent: Jun. 30, 2015

(54) LIGHT EMITTING DIODE AUTOMOBILE LAMP

(71) Applicant: Hon Hai Precision Industry Co., Ltd., New Taipei (TW)

(72) Inventor: Chih-Chen Lai, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 37 days.

(21) Appl. No.: 13/921,040

(22) Filed: Jun. 18, 2013

(65) Prior Publication Data

US 2014/0177245 A1 Jun. 26, 2014

(30) Foreign Application Priority Data

Dec. 21, 2012 (TW) ..... 101149098 A

(51) Int. Cl.
*F21K 99/00* (2010.01)
*F21S 8/10* (2006.01)

(52) U.S. Cl.
CPC ..... *F21S 48/1131* (2013.01); *F21S 48/1225* (2013.01); *F21S 48/14* (2013.01)

(58) Field of Classification Search
CPC ..... F21K 9/56; F21S 48/00
See application file for complete search history.

(56) References Cited

U.S. PATENT DOCUMENTS

| | | | | |
|---|---|---|---|---|
| 2007/0177401 | A1* | 8/2007 | Nakabayashi | 362/548 |
| 2007/0247865 | A1* | 10/2007 | Kinoshita et al. | 362/538 |
| 2007/0257272 | A1* | 11/2007 | Hutchins | 257/98 |
| 2010/0060169 | A1* | 3/2010 | Sugimoto et al. | 315/82 |
| 2011/0248624 | A1* | 10/2011 | Kishimoto et al. | 313/483 |
| 2012/0206931 | A1* | 8/2012 | Nakazato et al. | 362/510 |
| 2012/0212933 | A1* | 8/2012 | Toko | 362/84 |
| 2013/0027962 | A1* | 1/2013 | Takahashi et al. | 362/538 |
| 2013/0033885 | A1* | 2/2013 | Oh et al. | 362/516 |

* cited by examiner

*Primary Examiner* — Elmito Breval
(74) *Attorney, Agent, or Firm* — Novak Druce Connolly Bove + Quigg LLP

(57) ABSTRACT

An LED automobile lamp includes an LED light source, a shading portion and a lens. The shading portion is located between the LED light source and the lens. The LED light source includes a light outputting surface. The shading portion contains phosphor therein. Blue light emitted by the LED light source transmits to the shading portion and excites the phosphor to form yellow light which mixes with the blue light to generate white light.

9 Claims, 3 Drawing Sheets

LIGHT EMITTING DIODE AUTOMOBILE LAMP

BACKGROUND

1. Technical Field

The present disclosure generally relates to semiconductor lamp structures, and particularly to a light emitting diode (LED) automobile lamp having stable and reliable performance.

2. Description of the Related Art

LEDs have many advantages, such as high luminosity, low operational voltage, low power consumption, compatibility with integrated circuits, faster switching, long term reliability, and environmental friendliness which have promoted their wide use as a light source.

A conventional LED automobile lamp includes an LED light source, a reflecting shell, a shading portion and a lens. The LED light source includes an LED die and an encapsulation layer with phosphor to cover the LED die. Blue light generated by the LED die excites the phosphor in the encapsulation layer to form white light. The white light is reflected by the reflecting shell and converged to the shading portion. The white light is regulated to a preset luminance shape and radiates to ambient environment through the lens. However, the blue light generated by the LED die have different brightness in a radiation angle, and heats generated by the LED die influences a stability of the phosphor contained in the encapsulation layer, which lead to the white light radiating out from the LED light source having uneven hue, some part being blue-white and some part being yellow-white.

Therefore, it is desirable to provide an LED automobile lamp which can overcome the above-described problems.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present LED automobile lamp. Moreover, in the drawings, all the views are schematic, and like reference numerals designate corresponding parts throughout the views.

DETAILED DESCRIPTION

Figure 1:
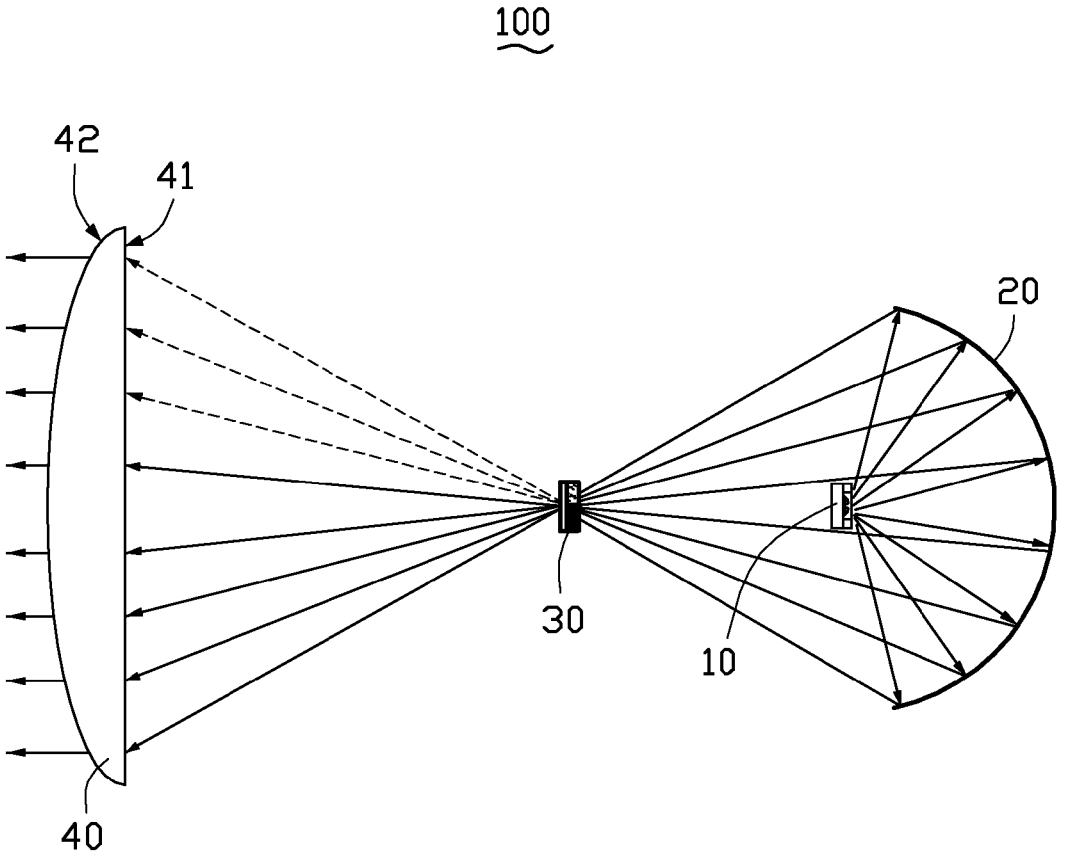
FIG. 1 is a schematic view of an LED automobile lamp in accordance with an exemplary embodiment of the present disclosure.

Referring to FIG. 1, an LED automobile lamp 100 in accordance with an embodiment is provided. The LED automobile lamp 100 includes an LED light source 10, a reflecting shell 20, a shading portion 30 and a lens 40.

Figure 2:
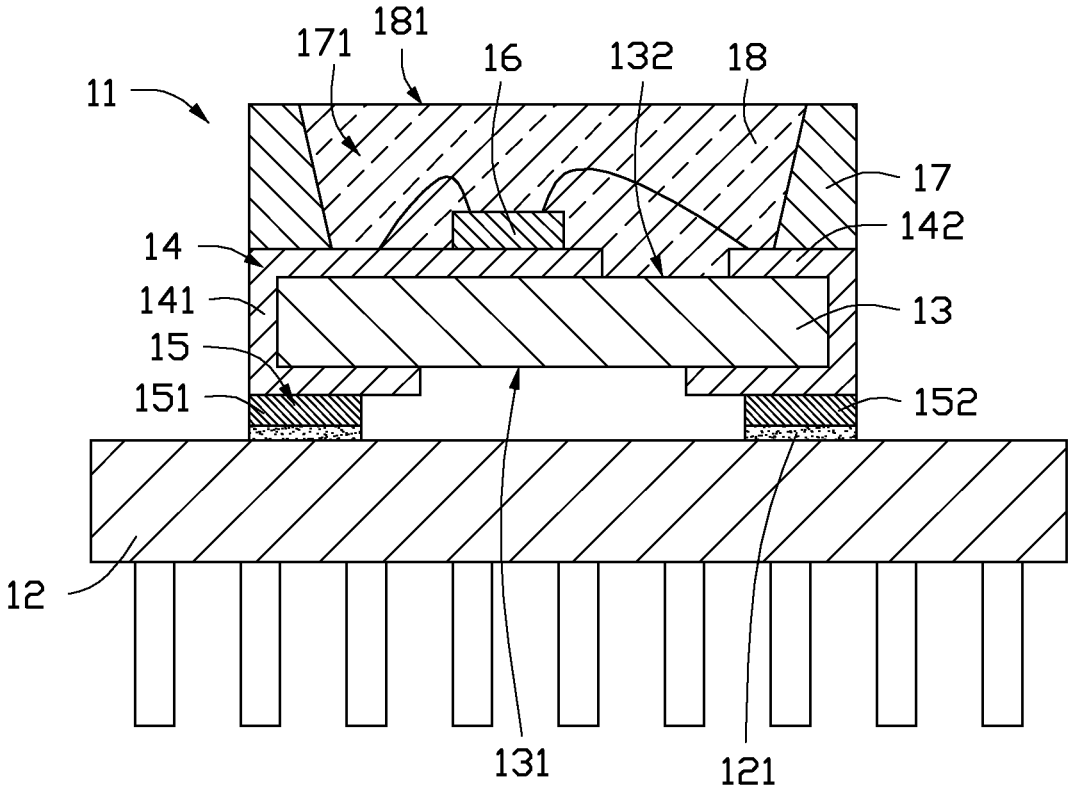
FIG. 2 is a cross-sectional view of an LED light source of the LED automobile lamp of FIG. 1.

Referring to FIG. 2, the LED light source 10 includes an LED package 11 and a printed circuit board (PCB) 12 supporting the LED package 11. Heat dissipating fins (not labeled) extend downwardly from a bottom of the PCB 12 away from the LED package 11 for facilitating heat dissipation of the LED package 11.

The LED package 11 includes a substrate 13, an electrode structure 14 disposed on the substrate 13, a pad structure 15 formed at a periphery of a bottom of the electrode structure 14, an LED die 16 mounted on the electrode structure 14, a reflector 17 surrounding the LED die 16 and an encapsulation layer 18 filled in the reflector 17 and covering the LED die 16.

Specifically, the substrate 13 is flat and includes a first surface 131 and a second surface 132 opposite to the first surface 131. In this embodiment, the substrate 13 is an electrically insulating substrate.

The electrode structure 14 includes a first electrode 141 and a second electrode 142 spaced from each other. Both the first electrode 141 and the second electrode 142 extend from the first surface 131 to the second surface 132 respectively. The pad structure 15 includes a first pad 151 and a second pad 152. The first pad 151 is mounted on a bottom end of the first electrode 141. The second pad 152 is mounted on a bottom end of the second electrode 142. Alternatively, the first pad 151 and the second pad 152 can be integrally formed with the first electrode 141 and the second electrode 142 respectively.

The LED die 16 is disposed on the first electrode 141. The LED die 16 electrically connects with the first electrode 141 and the second electrode 142 via wire bonding. In this embodiment, the LED die 16 emits blue light. The reflector 17 is disposed on the substrate 13, surrounds the LED die 16 and forms a recess 171 receiving the LED die 16 therein.

The encapsulation layer 18 is filled in the recess 171 and encapsulates the LED die 16 therein. The encapsulation layer 18 is made of transparent materials such as transparent resin or silicone. A top surface of the encapsulation layer 18 is coplanar to a top end of the reflector 17 and acts as a light outputting surface 181 of the LED package 11.

The PCB 12 is flat with circuits arranged thereon. Two solder slugs 121 are formed on the PCB 12 corresponding to the first pad 151 and the second pad 152. The LED package 11 electrically connects with the PCB 12 via the pads 151, 152 and the solder slugs 121 which mechanically and electrically connect the pads 151, 152 to the circuits of the PCB 12 after a reflow process which melts the solder slugs 121.

The LED light source 10 and the shading portion 30 are arranged between the reflecting shell 20 and the lens 40, and the LED light source 10 is located between the reflecting shell 20 and the shading portion 30. The LED light source 10 and the shading portion 30 are aligned with each other and correspond to centers of the reflecting shell 20 and the lens 40. A size of the LED light source 10 is smaller than that of the reflecting shell 20.

Specifically, the light outputting surface 181 of the LED light source 10 directly faces to a middle of the reflecting shell 20. The reflecting shell 20 includes a concave inner surface facing the light outputting surface 181 of the LED light source 10. High reflective materials can be coated at the concave inner surface to reflect and converge the blue light from the LED light source 10 to the shading portion 30.

Figure 3:
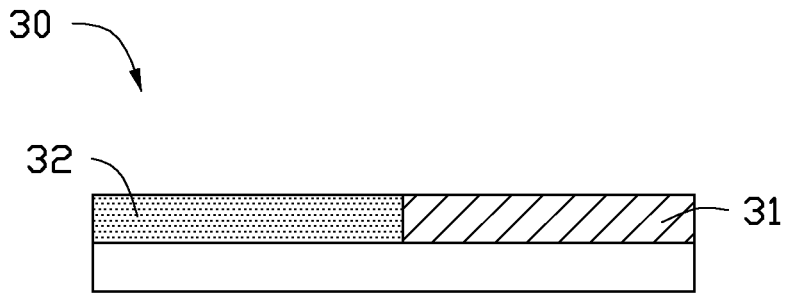
FIG. 3 is a cross-sectional view of a shading portion of the LED automobile lamp of FIG. 1.

The shading portion 30 is located between the LED light source 10 and the lens 40. Referring to FIG. 3, the shading portion 30 includes a shading sheet 31 and a transmission sheet 32. The transmission sheet 32 contains phosphor therein.

A shape of the shading portion 30 is designed according to a luminance shape generated by the LED automobile lamp 100. Specifically, the shading sheet 31 includes a side surface (not shown), and a shape of the side surface is the same as a cut-off line which complies with relevant law and regulations. When the blue light from the reflecting shell 20 reaches the shading portion 30, part of the blue light is blocked by the shading sheet 31, and the other part of the blue light entering the transmission sheet 32 is regulated to a preset luminance shape with cut-off line by the side surface. That is the shading portion 30 provides a cut-off line to regulate the blue light to a preset luminance shape.

When the other part of blue light penetrates the transmission sheet 32, the other part of the blue light with preset shape excites the phosphor to form yellow light which combines with the blue light to obtain white light. In this embodiment, the transmission sheet 32 contains yellow phosphor therein. Alternatively, the transmission sheet 32 can contain red phosphor and green phosphor to strengthen a color rendering property of the white light.

The lens 40 is a convex lens. The lens 40 includes an incident surface 41 and a light exit surface 42. The light exit surface 42 is spherical. The white light from the shading portion 30 enters the lens 40 via the incident surface 41 and radiates to ambient environment via the light exit surface 42. Alternatively, the lens 40 is an aspheric lens.

Since the phosphor originally contained in the encapsulation layer 18 of the LED light source 10 is transferred to the shading portion 30. Heats generated by the LED light source 10 will not influence the stability of the phosphor. When the blue light generated by the LED light source 10 reach the shading portion 30, the blue light excites phosphor contained in the shading portion 30 to form the yellow light. The yellow light mixes with the blue light to generate the white light. Accordingly, the white light radiated from the LED automobile lamp 100 has a uniform hue.

Alternatively, there's no reflecting shell 20 in the LED automobile lamp 100, and the light outputting surface 181 of the LED package 11 directly faces to the shading portion 30.

It is to be understood that the above-described embodiments are intended to illustrate rather than limit the disclosure. Variations may be made to the embodiments without departing from the spirit of the disclosure. The above-described embodiments illustrate the scope of the disclosure but do not restrict the scope of the disclosure.

What is claimed is:

1. A light emitting diode (LED) automobile lamp, comprising:

an LED light source having a light outputting surface, wherein the light source comprises an LED die and an encapsulation layer encapsulating the LED die, the encapsulation layer being made of transparent material, wherein the encapsulation layer is made of one of transparent resin and transparent silicone, a top surface of the encapsulation layer forming the light outputting surface;

a shading portion containing phosphor therein;

a lens; and a reflecting shell, wherein the reflecting shell comprising a concave inner surface, the LED light source being located between the shading portion and the reflecting shell, the light outputting surface facing to a middle of the concave inner surface of the reflecting shell; and wherein the shading portion is located between the LED light source and the lens, light emitted from the LED light source which has a first color transmitting to the shading portion and exciting the phosphor in the shading portion to generate light having a second color different from the first color, the light having the second color mixing with the light having the first color to form white light, wherein high reflective materials being coated at the concave inner surface to reflect and converge the blue light from the LED light source to the shading portion.

2. The LED automobile lamp of claim 1, wherein the shading portion comprises a shading sheet and a transmission sheet adjacent thereto, the phosphor being contained in the transmission sheet.

3. The LED automobile lamp of claim 1, wherein the LED die emits blue light via the light outputting surface.

4. The LED automobile lamp of claim 3, wherein the shading portion contains yellow phosphor therein.

5. The LED automobile lamp of claim 3, wherein the shading portion contains red phosphor and green phosphor therein.

6. The LED automobile lamp of claim 1, wherein the LED light source and the shading portion are aligned with each other and correspond to centers of the reflecting shell and the lens.

7. The LED automobile lamp of claim 1, wherein the lens is a convex lens, the lens comprising an incident surface and a light exit surface opposite to the incident surface, the white light from the shading portion entering the lens via the incident surface and radiating out via the light exit surface.

8. The LED automobile lamp of claim 7, wherein the light exit surface is spherical surface.

9. The LED automobile lamp of claim 7, wherein the lens is an aspheric lens.

* * * * *